US006195050B1

(12) United States Patent
Kim

(10) Patent No.: US 6,195,050 B1
(45) Date of Patent: Feb. 27, 2001

(54) AUTOMATIC ANTENNA DEVICE FOR MULTIBAND MOBILE COMMUNICATION TERMINAL

(75) Inventor: Dong Hwan Kim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/439,753

(22) Filed: Nov. 15, 1999

(30) Foreign Application Priority Data

Nov. 14, 1998 (KR) ..... 98-48950

(51) Int. Cl.[7] ..... H01Q 21/30; H01Q 1/38; H01Q 1/24

(52) U.S. Cl. ..... 343/700 MS; 343/702; 343/725; 343/901

(58) Field of Search ..... 343/702, 725, 343/700 MS, 713, 901, 903; H01Q 1/38, 1/10, 1/24, 21/30

(56) References Cited

U.S. PATENT DOCUMENTS 5,212,725 * 5/1993 Yamamoto et al. ..... 343/903

5,760,744 * 6/1998 Sauer ..... 343/713

* cited by examiner

*Primary Examiner*—Michael C. Wimer
(74) *Attorney, Agent, or Firm*—Dilworth & Barrese, LLP

(57) ABSTRACT

An automatic antenna for a multiband mobile communication terminal. The automatic antenna comprises a microstrip antenna mounted on an upper part of a housing of the mobile communication terminal, the microstrip antenna having at least two microstrip line parts for different frequency signals; a motor with a toothed wheel mounted on a shaft thereof; a whip antenna having sawteeth formed on a side thereof, wherein the sawteeth are engaged with the toothed wheel to extend and retract the whip antenna by a rotation force of the motor; a feeder electrically connected to a main board of the mobile communication terminal and the microstrip antenna, the feeder being electrically connected to the whip antenna by coupling effect; an insulating tube along which the whip antenna is movable, for preventing antenna radiation of the whip antenna; and an antenna support for supporting the whip antenna.

12 Claims, 4 Drawing Sheets

AUTOMATIC ANTENNA DEVICE FOR MULTIBAND MOBILE COMMUNICATION TERMINAL

This application claims priority to an application entitled "Automatic Antenna Device for Multiband Mobile Communication Terminal" filed in the Korean Industrial Property Office on Nov. 14, 1998 and assigned Serial No. 98-48950, the contents of which are hereby incorporated by reference.

BACKGROUND OF THE INVENTION

1. Field of the Invention

The present invention relates generally to a multiband mobile communication terminal, and in particular, to an automatic antenna device and method for automatically controlling an extended length of a whip antenna according to frequency bands.

2. Description of the Related Art

With the rapid development of mobile communication technology, various communication services are presently provided that use different communication systems and standards. At present, these services are not compatible with one another. Therefore, it is necessary to allow an existing mobile communication system to work with another mobile communication system. For example, have an existing CDMA (Code Division Multiple Access) terminal with a PCS (Personal Communication System) terminal; an existing AMPS (Advanced Mobile Phone Service) terminal with an US (United States) PCS terminal; and an existing GSM (Group Special Mobile) terminal with a DECT (Digital European Cordless Telephone) terminal or a DCS-1800 (Digital Communication System-1800) terminal which is a GSM terminal applied to a 1,800 MHz band. In addition, it is also necessary to allow more than three different communication systems to work with one another. A mobile communication terminal which can operate simultaneously with two or more communication systems is called a dual-band or multiband mobile communication terminal. Conventionally, the multiband mobile communication terminal has an antenna device comprised of multiple antennas according to the frequency bands received. This results in an increase in the size and the cost of the terminal. Alternatively, the conventional multiband mobile communication terminal having a single antenna includes an antenna matching circuit to support the multiple frequency bands. This results in an increase in complexity.

SUMMARY OF THE INVENTION

It is, therefore, an object of the present invention to provide an automatic antenna device for a multiband mobile communication terminal, which includes an automatic antenna extending device for automatically controlling the extension of a whip antenna according to the frequency bands received.

To achieve the above object, there is provided an automatic antenna for a multiband mobile communication terminal. The automatic antenna contains a microstrip antenna mounted on an upper part of a housing of the mobile communication terminal. The microstrip antenna has at least two microstrip line parts for receiving different frequency signals. In addition, a motor with a toothed wheel mounted on a shaft thereof extends or retracts a whip antenna having corresponding sawteeth formed on a side thereof. A feeder is electrically connected to a main board of the mobile communication terminal and the microstrip antenna. The feeder is similarly electrically connected to the whip antenna by a coupling effect. An insulating tube inside which the whip antenna moves is provided for preventing antenna radiation of the whip antenna from causing interference. An antenna support is provided for supporting the whip antenna.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
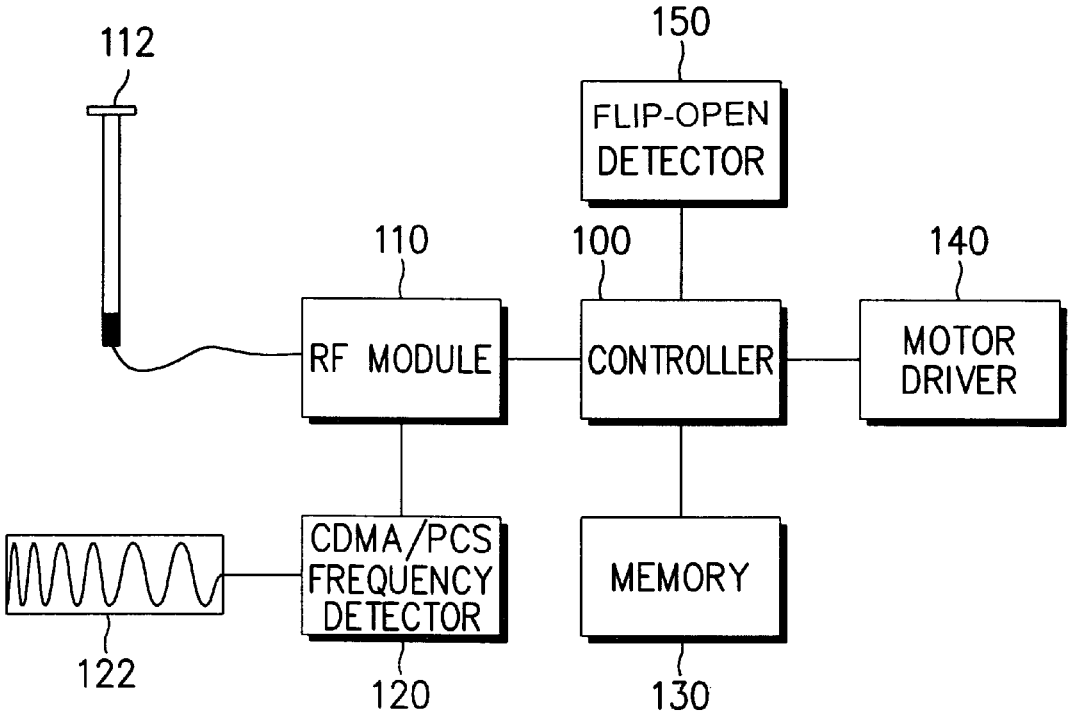
FIG. 1 is a block diagram illustrating a multiband mobile communication terminal including an automatic antenna device according to an embodiment of the present invention.

FIG. 1 illustrates a block diagram of a multiband mobile communication terminal including an automatic antenna device according to an embodiment of the present invention. Referring to FIG. 1, a controller 100 controls the overall operation of the multiband mobile communication terminal according a control program stored therein. The controller 100 is typically comprised of a one-chip microprocessor. A memory 130 stores initial system data of the multiband mobile communication terminal, the control program for the controller 100, the data generated during execution of the control program, and the data required for various functions. In addition, the memory 130 registers therein information about the multiple mobile communication systems supported by the multiband mobile communication terminal, information about the frequency bands of the respective systems, service information according to the frequency bands. A flip-open detector 150 detects the ON/OFF state of a flip portion of a mobile terminal and provides a detection signal to the controller 100. When the flip portion of the terminal is open, the terminal is in an ON state and when the flip portion is closed, the terminal is in an OFF state. The flip-open detector 150 is used only for a flip-type terminal. An RF (Radio Frequency) module 110 frequency-converts an RF signal which is received and transmitted from and to a whip antenna (or rod antenna) 112 and a microstrip antenna 122. In an embodiment of the present invention, the whip antenna 112 is used as a transmission antenna and is automatically extended and retracted under the control of a motor driver 140. The microstrip antenna is used as a receiving antenna and is internally disposed at an upper part of the mobile communication terminal body. A CDMA/PCS frequency detector 120 determines whether a frequency band of an RF signal received through the microstrip antenna 122 is a CDMA frequency band or a PCS frequency band. The controller 100 determines how far to extend the length of the whip antenna 112 according to the frequency band detected by the CDMA/PCS frequency detector 120.

Although FIG. 1 shows a CDMA/PCS dualband mobile communication terminal, the invention can also be applied to the GSM/DCS, AMPS/US-PCS, and GSM/DECT dualband mobile communication terminals. In addition, the invention can also be applied to a multiband mobile communication terminal supporting more than three frequency bands.

The motor driver 140, under the control of the controller 100, actuates a motor (39 in FIG. 3) to control the length of the whip antenna 112 during a call and automatically retract the whip antenna 112 upon completion of the call. The microstrip antenna 122 includes wide-space strip lines for receiving PCS signals and narrow-space strip lines for receiving CDMA signals. Therefore, the microstrip antenna 122 according to the present invention can receive both the PCS signals and the CDMA signals. It is understood that the microstrip antenna 122 is designed according to the different communication systems the multiband mobile communication terminal operates with.

Figure 2:
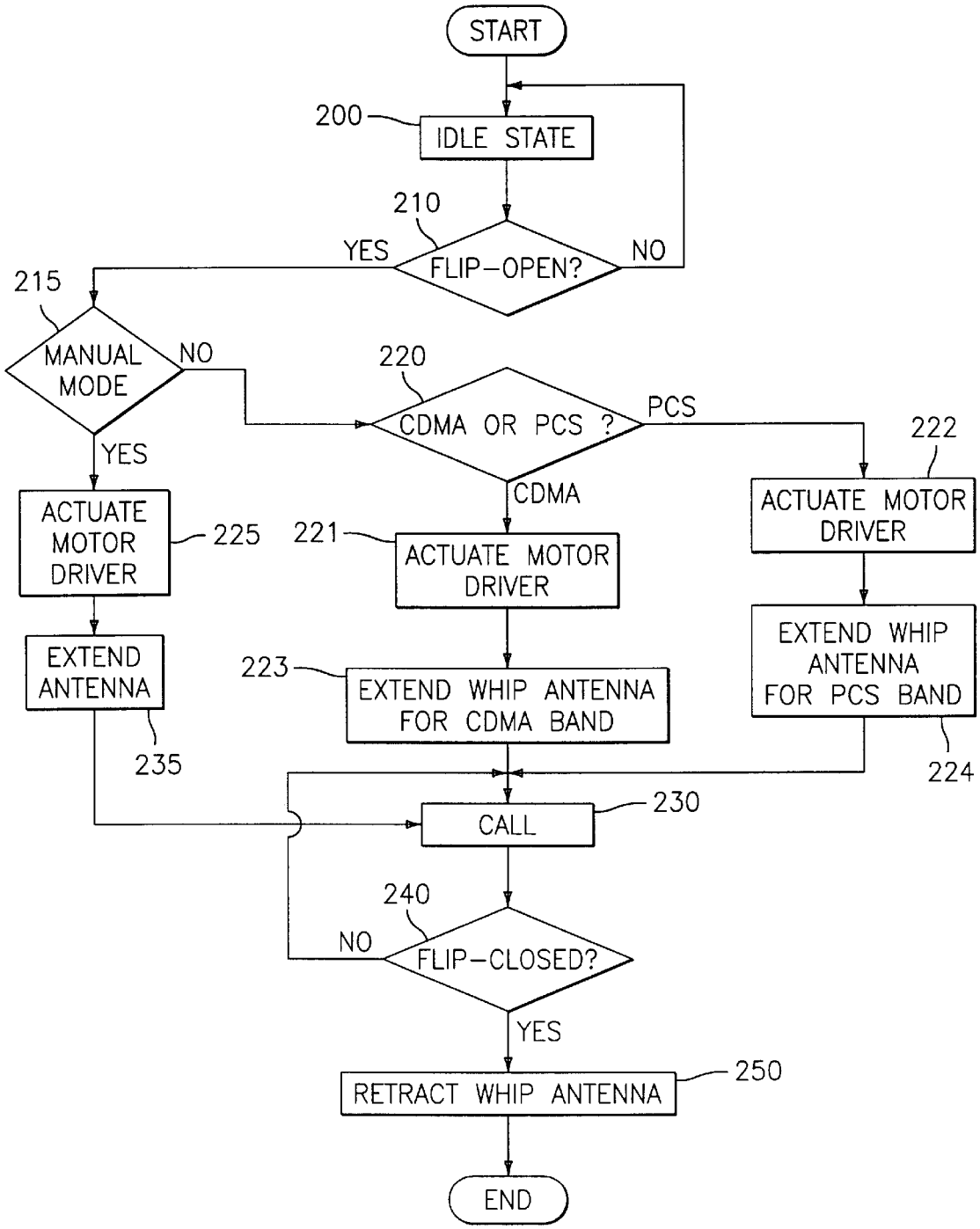
FIG. 2 is a flow chart illustrating a procedure for controlling an automatic antenna device for a multiband mobile communication terminal according to an embodiment of the present invention.

FIG. 2 is a flow chart illustrating a procedure for controlling an automatic antenna device for a CDMA/PCS dualband mobile communication terminal according to an embodiment of the present invention. Referring to FIG. 2, the mobile communication terminal in a idle state, step 200. The terminal determines, in step 210, whether the flip is opened (i.e., flip open/ON). Upon detection of the flip open state, it is determined in step 215 whether the terminal is set to a manual mode of operation. If so, step 225 actuates the motor driver 140 and step 235 extends the whip antenna 112 according to a manually entered value. Thereafter, in step 230, the call will proceed. If the terminal is not in manual mode in step 215, the terminal determines whether an RF signal received through the microstrip antenna 122 is a CDMA frequency band or a PCS frequency band. This is performed by comparing the received RF signal to a threshold amount. When the CDMA band signal is received, the mobile communication terminal is set to a CDMA mode of operation and actuates the motor driver 140, in step 221. Thereafter, in step 223, an extended length of the whip antenna 112 is controlled to be suitable for the CDMA frequency band. It is well known that an antenna length for the CDMA frequency band is over twice an antenna length for the PCS frequency band. After extending the whip antenna 112 for the CDMA frequency band, the mobile communication terminal performs a call in step 230. During a call, it is determined in step 240 whether the flip is closed (i.e., flip closed). Upon detection of the flip closed state (OFF), the mobile communication terminal retracts the whip antenna 112 by actuating the motor driver 140, in step 250.

However, if it is determined in step 220 that the PCS band signal is received, the mobile communication terminal is set to a PCS mode of operation and actuates the motor driver 140, in step 222. Thereafter, in step 224, an extended length of the whip antenna 112 is controlled to be suitable for the PCS frequency band. Thereafter, the mobile communication terminal performs the step 230 and the succeeding steps.

In the case where the mobile communication systems supporting the dualband mobile communication terminal provide a roaming service, the extended length of the whip antenna 112 is changed automatically each time the mobile communication terminal is handed off to a base station of the corresponding mobile communication system. For example, if the mobile communication terminal is handed off to a PCS base station while performing a call through a CDMA base station, the whip antenna 112 is automatically retracted by half. Thereafter, if the mobile communication terminal is handed off back to the CDMA base station, the whip antenna 112 is automatically extended to the original state.

Figure 3:
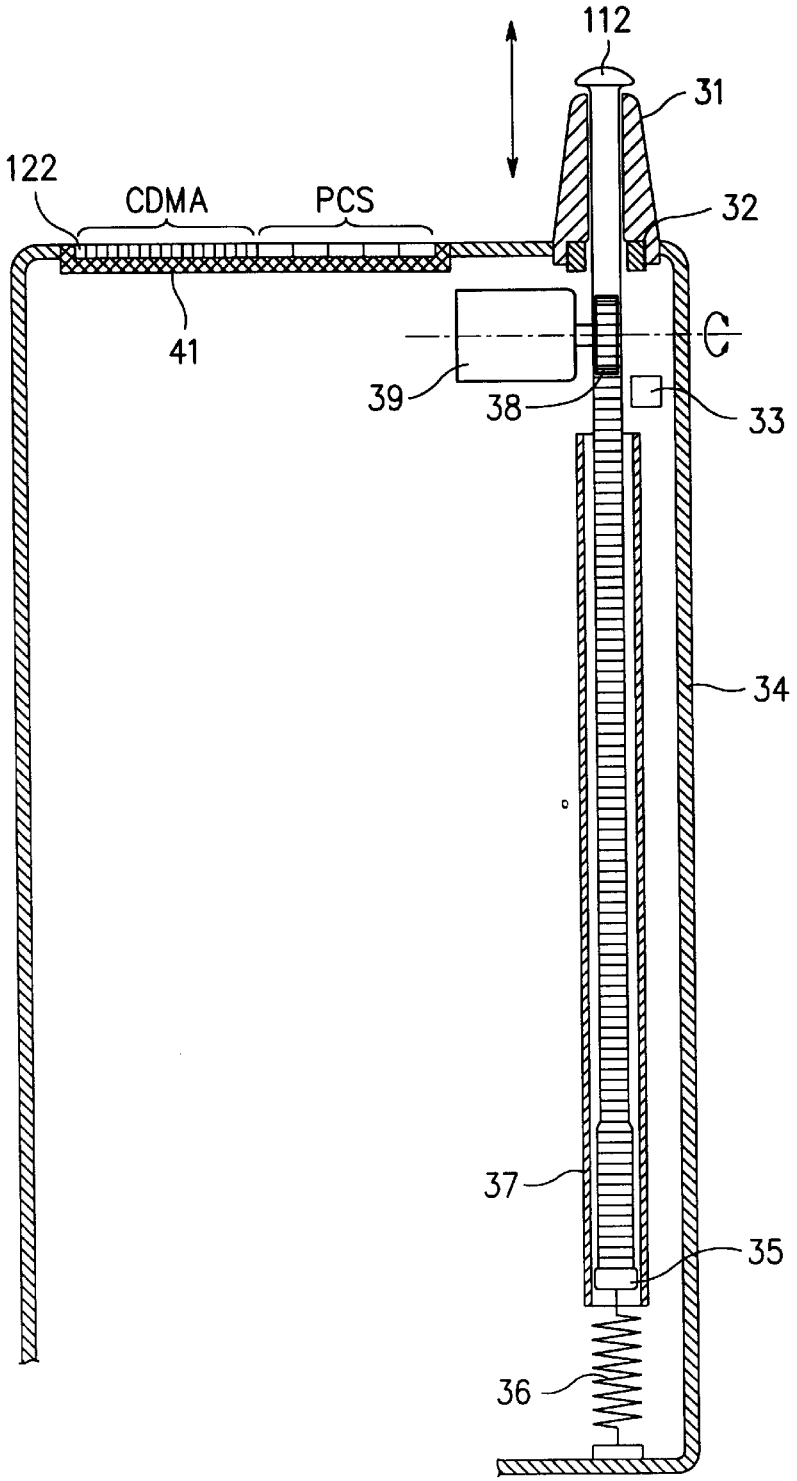
FIG. 3 is a cross-sectional view illustrating an automatic antenna device according to an embodiment of the present invention.
Figure 4:
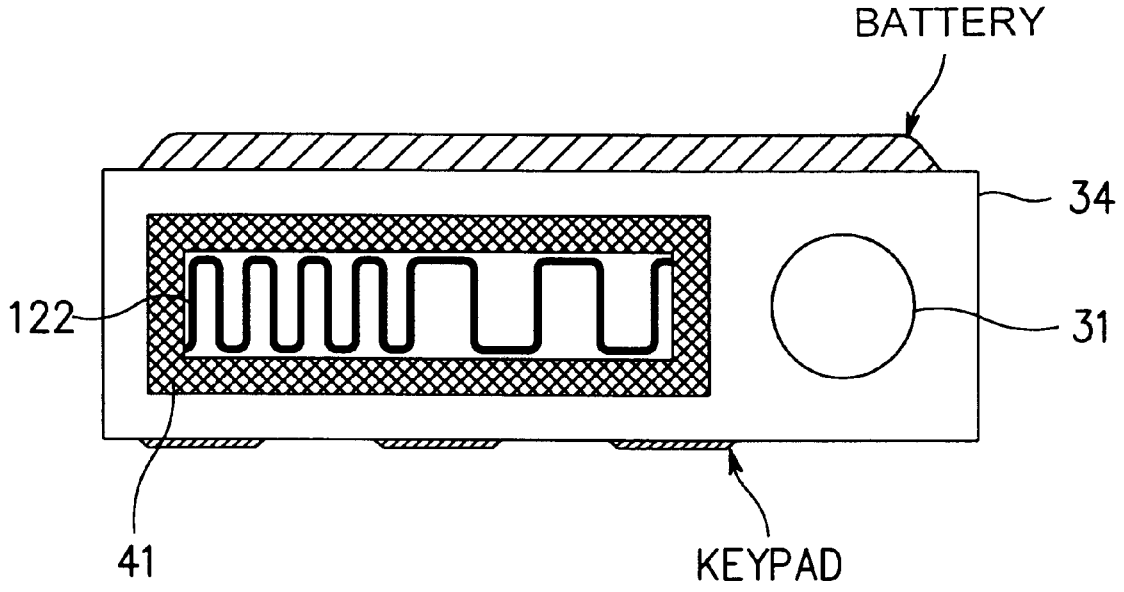
FIG. 4 is a plane view illustrating an automatic antenna device according to an embodiment of the present invention.

FIG. 3 is a cross-sectional view illustrating an automatic antenna device according to an embodiment of the present invention, and FIG. 4 is a plane view illustrating an automatic antenna device according to an embodiment of the present invention.

Referring to FIGS. 3 and 4, the whip antenna 112 is extended and retracted along an antenna guide hole formed at an antenna support 31 mounted on an upper part of a housing 34. The whip antenna 112 has sawteeth formed at a side thereof so that the sawteeth are engaged with a toothed wheel 38 mounted on a shaft of a motor 39. The motor 39 is controlled by the controller 100 and motor driver 140. When the shaft of motor 39 rotates, the toothed wheel 38 attached also rotates and extends or retracts the whip antenna 112. The antenna support 31 is fixed to the housing 34 through a bushing 32. A feeder 33 is electrically connected in common to the RF module 110 and the microstrip antenna 122 mounted on an upper part of the housing 34. In addition, the feeder 33 maintains a fine gap with a side of the whip antenna 112, so that the feeder 33 can be electrically connected to the whip antenna 112 by a coupling effect without a separate antenna matching circuit. Therefore, the microstrip antenna 122 and the whip antenna 112 are commonly connected to the feeder 33. An insulating tube 37 is installed in the housing 34 so that antenna radiation of the whip antenna 112 can be prevented when the whip antenna 112 is retracted by half along the insulating tube 37 in the PCS mode of operation. The whip antenna 112 has a stopper 35 formed at the bottom so that the whip antenna 112 cannot fall off from the antenna support 31 when the whip antenna 112 is fully extended.

The microstrip antenna 122 mounted on the upper part of the housing 34 is divided into the wide-space strip lines and the narrow-space strip lines. An insulating plate 41 is interposed between the microstrip antenna 122 and the housing 34 so as to prevent antenna radiation of the microstrip antenna 122 from affecting the devices of the mobile communication terminal. In addition, a coil spring 36 is fixed between the stopper 35 and the bottom of the housing 34, to tightly fix the whip antenna 112 to the housing 34 when it is retracted. Accordingly, the whip antenna 112 cannot be drawn out by the attraction force of the coil spring 36 unless the motor 39 is actuated. In addition, a separate insulating substance is formed between the coil spring 36 and the stopper 35 to prevent coupling between the whip antenna 112 and the coil spring 36.

As described above, the novel automatic antenna device for a multiband mobile communication terminal can automatically control the length of the whip antenna, thereby contributing to the convenience of the user.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. An automatic antenna device for a multiband mobile communication terminal having a flip portion and a flip open detector to determine an open and a closed state of the flip portion, said antenna device comprising:

a motor with a toothed wheel mounted on a shaft thereof;

a whip antenna which can be extended and retracted by a rotation force of the toothed wheel, the whip antenna transmitting a frequency signal corresponding to an extended length with respect to a body of the terminal;

a microstrip antenna for receiving at least two frequency signals; and a controller for actuating, upon detection of the flip open state, the motor to extend the whip antenna to a predetermined extent according to a frequency signal received through the microstrip antenna.

2. The automatic antenna device as claimed in claim 1, wherein upon detection of the flip open state, the controller actuates the motor to extend the whip antenna to a predetermined extent corresponding to a previously set frequency signal, in a manual mode of operation.

3. A method for controlling an automatic antenna device for a multiband mobile communication terminal including a flip portion, a flip open detector for determining an open and closed state of the flip portion, a microstrip antenna for receiving multi-frequency signals, a whip antenna for transmitting different frequency signals according to an extended length thereof, and a motor for extending and retracting the whip antenna, the method comprising the steps of:

detecting a state of the flip portion;

upon detection of the flip open state, determining a frequency band of a signal received through the microstrip antenna, the receiving signal being higher in strength than a threshold;

actuating the motor to extend the whip antenna to a predetermined extent according to the determined frequency band; and upon detection of the flip closed state, actuating the motor to retract the whip antenna.

4. An automatic antenna for a multiband mobile communication terminal, comprising:

a microstrip antenna mounted on an upper part of a housing of the mobile communication terminal, the microstrip antenna having at least two microstrip line parts for different frequency signals;

a motor with a toothed wheel mounted on a shaft thereof;

a whip antenna having a sawtooth portion formed on a side thereof, wherein the sawtooth portion is engaged with the toothed wheel to extend and retract the whip antenna by a rotation force of the motor;

a feeder electrically connected to a main board of the mobile communication terminal and the microstrip antenna, the feeder being electrically connected to the whip antenna by a coupling effect;

an insulating tube along which the whip antenna is movable, for preventing antenna radiation of the whip antenna; and an antenna support for supporting the whip antenna.

5. The automatic antenna device as claimed in claim 4, further comprising an insulating plate interposed between the microstrip antenna and the housing.

6. The automatic antenna device as claimed in claim 4, further comprising:

a stopper formed at a bottom of the whip antenna; and a coil spring fixed between the bottom of the stopper and the housing.

7. The automatic antenna device as claimed in claim 6, further comprising an insulating substance between the coil spring and the stopper.

8. The automatic antenna device as claimed in claim 4, wherein the feeder maintains a fine gap with the whip antenna so that the feeder can be electrically connected by a coupling effect.

9. An automatic antenna device for a multiband mobile communication terminal, comprising:

a whip antenna for transmitting a frequency signal corresponding to an antenna length;

a motor for extending and retracting said whip antenna;

a microstrip antenna for receiving at least two frequency signals;

a controller for determining a predetermined extent to extend the length of said whip antenna according to the frequency signal received through said microstrip antenna and for actuating said motor to said predetermined extent.

10. The automatic antenna device according to claim 9 wherein said terminal includes a flip portion and a flip open detector for detecting an open and a closed state of the flip portion, and wherein said controller actuates said motor upon detection of the flip open state.

11. A method for controlling an automatic antenna device for a multiband mobile communication terminal prior to a call, the terminal including a microstrip antenna for receiving multi-frequency signals, a whip antenna for transmitting different frequency signals according to an extended length thereof, and a motor for extending and retracting the whip antenna, the method comprising the steps of:

determining a frequency band of a signal received through the microstrip antenna;

actuating the motor to extend the whip antenna, upon detection of a flip open state to a predetermined extent according to the determined frequency band.

12. The method for controlling an automatic antenna device for a multiband mobile communication terminal according to claim 11 further comprising the step of completely retracting said whip antenna upon completion of the call.

* * * * *